US010494804B2

(12) United States Patent
Tsuruta et al.

(10) Patent No.: US 10,494,804 B2
(45) Date of Patent: Dec. 3, 2019

(54) SANITARY WASHING DEVICE

(71) Applicant: AISIN SEIKI KABUSHIKI KAISHA, Kariya-shi (JP)

(72) Inventors: Yoshihisa Tsuruta, Anjo (JP); Tomohiro Hamajima, Chita-gun (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 94 days.

(21) Appl. No.: 15/860,859

(22) Filed: Jan. 3, 2018

(65) Prior Publication Data

US 2018/0223518 A1 Aug. 9, 2018

(30) Foreign Application Priority Data

Feb. 6, 2017 (JP) ..... 2017-019165

(51) Int. Cl.

| | |
|---|---|
| ***E03D 9/08*** | (2006.01) |
| ***B05B 7/04*** | (2006.01) |
| ***B05B 1/14*** | (2006.01) |
| ***A47K 13/30*** | (2006.01) |

(52) U.S. Cl.

CPC ..... *E03D 9/08* (2013.01); *B05B 7/04* (2013.01); *A47K 13/302* (2013.01); *B05B 1/14* (2013.01)

(58) Field of Classification Search

CPC ..... E03D 9/08; B05B 15/20; B05B 15/555
USPC ..... 4/420.1–420.5, 443–448, 222–233
See application file for complete search history.

(56) References Cited

FOREIGN PATENT DOCUMENTS

| | | | |
|---|---|---|---|
| CN | 2307843 Y | * | 2/1999 |
| JP | 2005-336856 | | 12/2005 |
| JP | 2008-121303 | | 5/2008 |
| JP | 4343211 | | 10/2009 |
| JP | 2011-106175 | | 6/2011 |

OTHER PUBLICATIONS

English machine translation of CN 2307843 Y dated May 30, 2019 (Year: 1999).*

* cited by examiner

*Primary Examiner* — Christine J Skubinna
(74) *Attorney, Agent, or Firm* — Oblon, McClelland, Maier & Neustadt, L.L.P.

(57) ABSTRACT

A sanitary washing device includes: a nozzle configured to wash a local region of a human body; a tank configured to accommodate a sterilizing agent, a sterilizing component of which is dissolved into liquid, and to store supplied liquid therein; a nozzle washing unit configured to wash the nozzle using liquid supplied from the tank; and a buffering unit disposed between the sterilizing agent and an inner wall of the tank inside the tank and having liquid permeability.

5 Claims, 10 Drawing Sheets

SANITARY WASHING DEVICE

CROSS REFERENCE TO RELATED APPLICATIONS

This application is based on and claims priority under 35 U.S.C. § 119 to Japanese Patent Application 2017-019165, filed on Feb. 6, 2017, the entire contents of which are incorporated herein by reference.

TECHNICAL FIELD

This disclosure relates to a sanitary washing device.

BACKGROUND DISCUSSION

JP 2011-106175 A (Reference 1) discloses a sanitary washing device including a nozzle, which washes a local region of a human body, a water tank (tank), which stores wash water to be supplied to the nozzle, and a case, which accommodates a block-shaped sterilizing agent and is disposed inside the water tank. In this sanitary washing device, the sterilizing agent is submerged in the water inside the water tank so that a sterilizing component thereof is gradually dissolved.

However, in the sanitary washing device described above, a water stream may be generated in the water tank, for example, when tap water is supplied to the water tank or when the wash water is supplied from the water tank toward the nozzle. In this case, the sterilizing agent accommodated in the case may collide with the case thereof, thus generating abnormal noise.

Thus, a need exists for a sanitary washing device which is not susceptible to the drawback mentioned above.

SUMMARY

A sanitary washing device according to an aspect of this disclosure includes: a nozzle configured to wash a local region of a human body; a tank configured to accommodate a sterilizing agent, a sterilizing component of which is dissolved into liquid, and to store supplied liquid therein; a nozzle washing unit configured to wash the nozzle using liquid supplied from the tank; and a buffering unit disposed between the sterilizing agent and an inner wall of the tank inside the tank and having liquid permeability.

BRIEF DESCRIPTION OF THE DRAWINGS

The foregoing and additional features and characteristics of this disclosure will become more apparent from the following detailed description considered with the reference to the accompanying drawings, wherein:

FIGS. 5A and 5B are side cross-sectional views of a nozzle unit and a nozzle washing unit, in which FIG. 5A illustrates a state where a nozzle is disposed at a storage position, and FIG. 5B illustrates a state where the nozzle is disposed at a protruding position;

DETAILED DESCRIPTION

Hereinafter, an embodiment of a sanitary washing device will be described with reference to the drawings.

Figure 1:
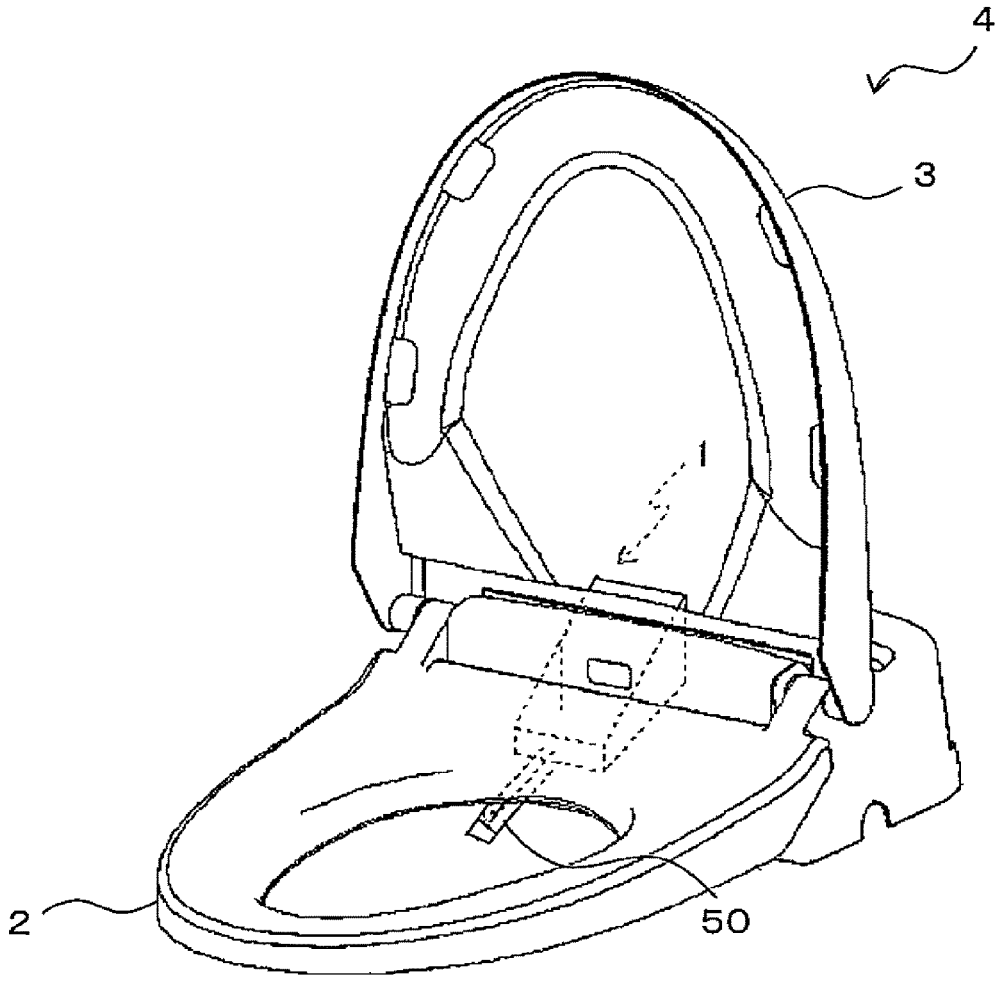
FIG. 1 is a perspective view of a toilet seat having a sanitary washing device according to one embodiment.

As illustrated in FIG. 1, a toilet seat device 4 includes a toilet seat 2 on which a user sits, a toilet lid 3, which covers the toilet seat 2, and a sanitary washing device 1, which washes a local region of a user.

Figure 2:
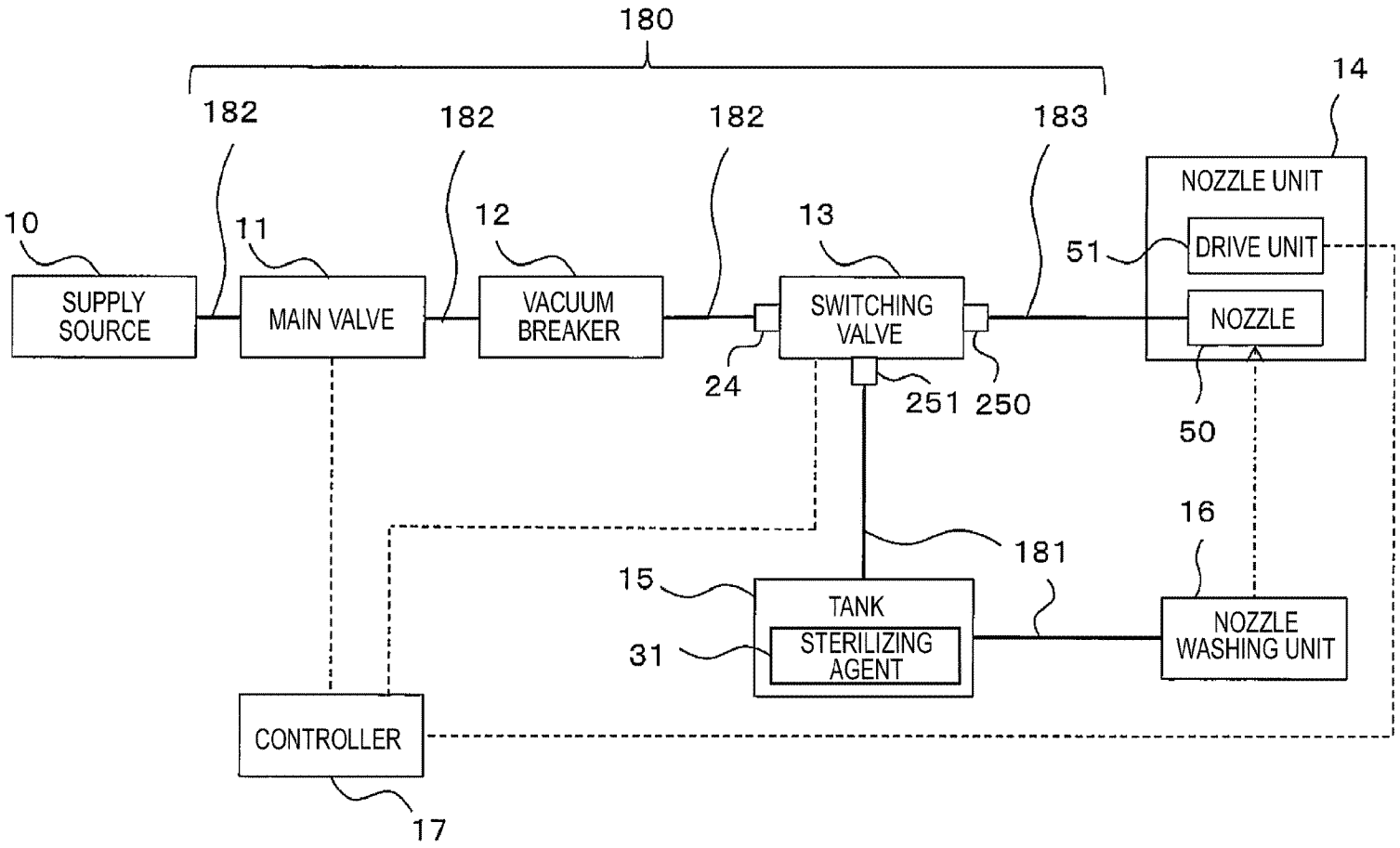
FIG. 2 is a diagram illustrating a configuration of the sanitary washing device.

As illustrated in FIG. 2, the sanitary washing device 1 includes a main valve 11, which switches the supply state of water supplied from a supply source 10, which supplies water (wash water) as an example of liquid, a vacuum breaker 12, which suppresses the occurrence of a vacuum state by introducing the air, a switching valve 13, which switches the supply destination of water, a nozzle unit 14, which washes a local region of the human body by spraying water from a nozzle 50, a tank 15, which accommodates a sterilizing agent 31 therein, a nozzle washing unit 16, which washes the nozzle 50, and a controller 17, which controls the main valve 11, the switching valve 13, and the nozzle unit 14.

In addition, the sanitary washing device 1 includes a supply flow path 180, which interconnects the supply source 10 and the nozzle unit 14, and a branch flow path 181, which interconnects the supply flow path 180 and the nozzle washing unit 16. In the supply flow path 180, a portion from the supply source 10 to the connection portion with the branch flow path 181 will be referred to as a "first supply flow path 182," and a portion from the connection portion to the nozzle unit 14 will be referred to as a "second supply flow path 183."

As illustrated in FIG. 2, the supply source 10 is connected to the main valve 11 via the first supply flow path 182. The supply source 10 is, for example, a water service that supplies water to the main valve 11.

As illustrated in FIG. 2, the main valve 11 is electrically connected to the controller 17. The main valve 11 is a solenoid valve that is switched to a valve opening state or a valve closing state. The opening/closing state of the main valve 11 is switched by an input signal from the controller 17. The main valve 11 is provided between the supply source 10 and the vacuum breaker 12 in the first supply flow path 182.

The main valve 11 allows the supply of water from the supply source 10 to the vacuum breaker 12 in the valve opening state. In addition, in the valve closing state, the main valve 11 limits the supply of water from the supply source 10 to the vacuum breaker 12.

Figure 3:
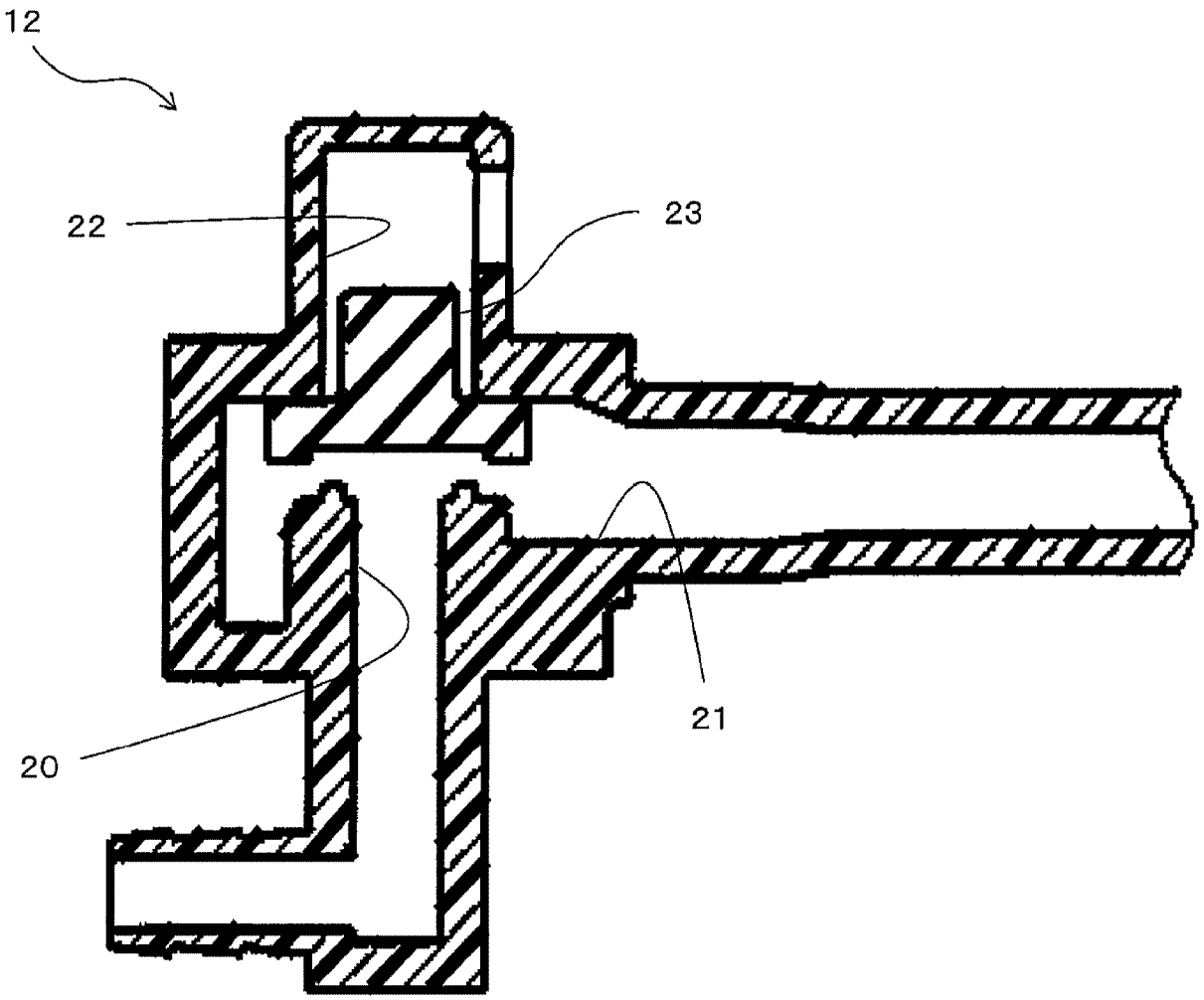
FIG. 3 is a side cross-sectional view of a vacuum breaker at the time of passing water therethrough.

As illustrated in FIG. 3, the vacuum breaker 12 includes an inlet flow path 20, an outlet flow path 21, an atmosphere communication port 22, and a valve body 23. The inlet flow path 20 is connected to the main valve 11 via the first supply flow path 182. The outlet flow path 21 is connected to the switching valve 13 via the first supply flow path 182. That is, the vacuum breaker 12 is provided on the upstream side of the switching valve 13 in the first supply flow path 182 of the supply flow path 180.

In addition, the atmosphere communication port 22 is opened to the atmosphere. The valve body 23 switches the connection state between the inlet flow path 20 and the outlet flow path 21 and the atmosphere communication port 22.

As illustrated in FIG. 3, when the water supplied from the supply source 10 is supplied from the first supply flow path 182, which is connected to the upstream side of the vacuum breaker 12, to the inlet flow path 20, the valve body 23 is pushed up by the water introduced from the inlet flow path 20. Thus, the outlet flow path 21 is connected to the inlet flow path 20, and is not connected to the atmosphere communication port 22. Therefore, the water supplied from the supply source 10 is supplied to the switching valve 13.

Figure 4:
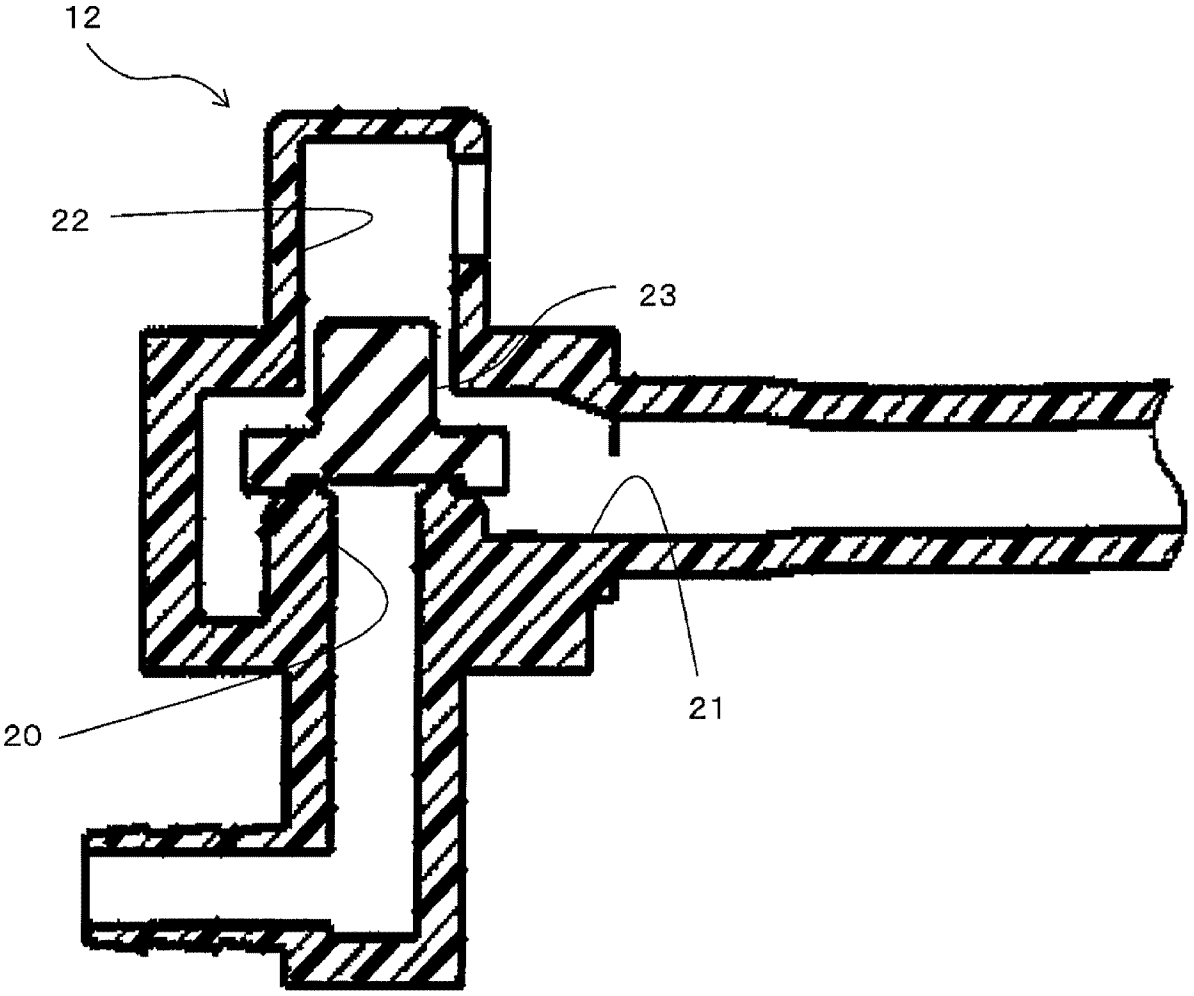
FIG. 4 is a side cross-sectional view of the vacuum breaker at the time of not passing water therethrough.

On the other hand, as illustrated in FIG. 4, when the water supplied from the supply source 10 is not supplied from the first supply flow path 182, which is connected to the upstream side of the vacuum breaker 12, to the inlet flow path 20, the valve body 23 is lowered by gravity. Thus, the outlet flow path 21 is connected to the atmosphere communication port 22, and is not connected to the inlet flow path 20. Therefore, the air is introduced from the atmosphere communication port 22 into the outlet flow path 21. That is, the vacuum breaker 12 opens the first supply flow path 182, which is connected to the downstream side of the vacuum breaker 12, to the atmosphere.

As illustrated in FIG. 2, the switching valve 13 is provided on the connection portion of the supply flow path 180 with the branch flow path 181. The switching valve 13 includes an inlet portion 24 connected to the outlet flow path 21 of the vacuum breaker 12 via the first supply flow path 182, a first outlet portion 250 connected to the nozzle unit 14 via the second supply flow path 183, and a second outlet portion 251 connected to the tank 15 via the branch flow path 181.

The switching valve 13 is electrically connected to the controller 17. The switching valve 13 is switched to any one of a state where the inlet portion 24 and the first outlet portion 250 communicate with each other, a state where the inlet portion 24 and the second outlet portion 251 communicate with each other, and a state where the inlet portion 24 does not communicate with any one of the first outlet portion 250 and the second outlet portion 251. The communication state of the switching valve 13 is switched by an input signal from the controller 17.

That is, the switching valve 13 switches the connection state of the supply flow path 180 and the branch flow path 181. Specifically, the switching valve 13 switches the connection state to any one of a state where the first supply flow path 182 and the second supply flow path 183 are connected to each other, a state where the first supply flow path 182 and the branch flow path 181 are connected to each other, and a state where the first supply flow path 182 is connected to none of the second supply flow path 183 and the branch flow path 181.

When the switching valve 13 is in a state where the inlet portion 24 and the first outlet portion 250 communicate with each other, the first outlet portion 250 discharges the water introduced from the inlet portion 24 to the nozzle unit 14. In addition, when the switching valve 13 is in a state where the inlet portion 24 and the second outlet portion 251 communicate with each other, the second outlet portion 251 discharges the water introduced from the inlet portion 24 to the tank 15. When the switching valve 13 is in a state where the inlet portion 24 communicates with none of the first outlet portion 250 and the second outlet portion 251, no movement of water occurs in the switching valve 13.

Figure 5A:
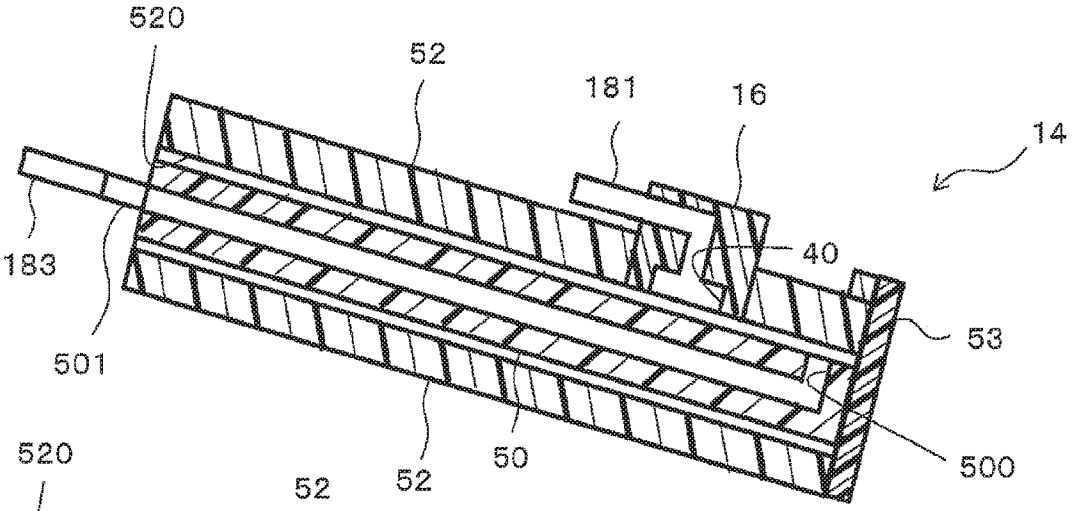
Figure 5B:
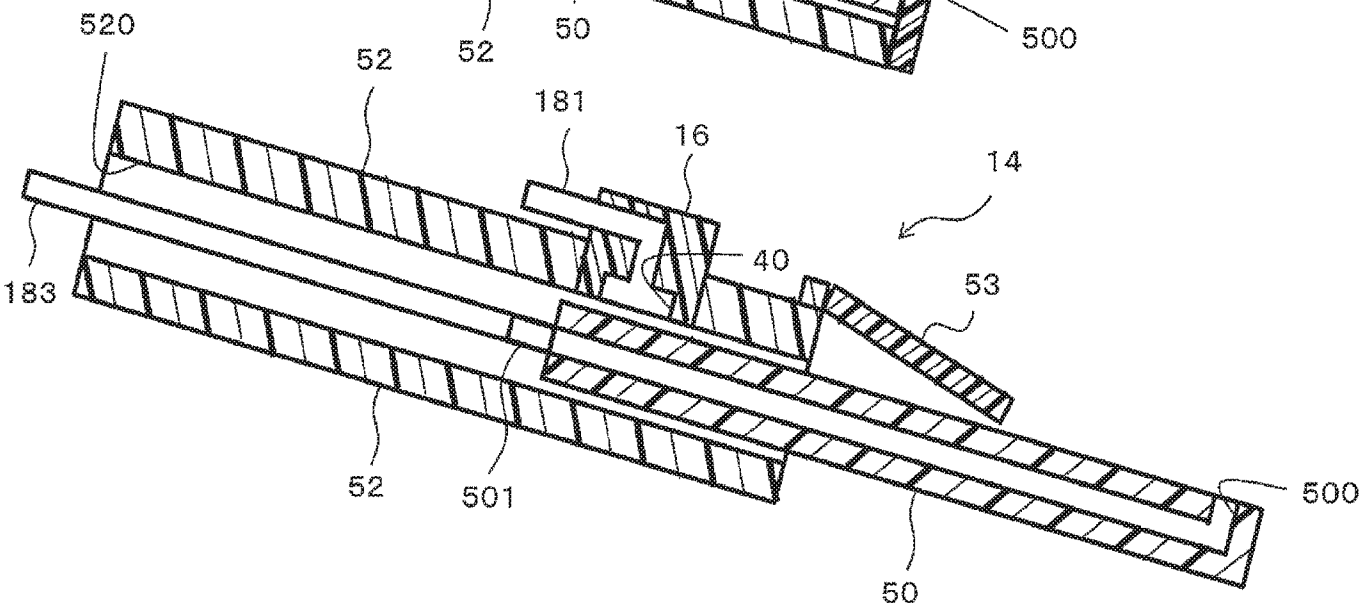

As illustrated in FIG. 2 and FIGS. 5A and 5B, the nozzle unit 14 includes the nozzle 50, which sprays water, a drive unit 51, which moves the nozzle 50, a nozzle receptacle 52, which accommodates the nozzle 50 therein, and a shutter 53, which shields the tip end of the nozzle 50 from the outside.

As illustrated in FIG. 5A, the nozzle 50 has a columnar shape. The nozzle 50 includes a connecting portion 501 at one end thereof in the longitudinal direction of the nozzle 50 and a spray port 500 at the other end thereof in the longitudinal direction. The connecting portion 501 is connected to the first outlet portion 250 of the switching valve 13 via the second supply flow path 183. The connecting portion 501 and the spray port 500 communicate with each other in the inside of the nozzle 50. Thus, the water introduced from the connecting portion 501 is sprayed from the spray port 500. Therefore, the nozzle 50 washes a local region of the human body by spraying the water supplied from the supply source 10 from the spray port 500.

As illustrated in FIG. 2, the drive unit 51 is electrically connected to the controller 17. The drive unit 51 may include, for example, a motor and a conversion mechanism, which converts rotation of the motor into linear movement of the nozzle 50. Then, the drive unit 51 moves the nozzle 50 back and forth between a "protruding position", which is the position at which the nozzle 50 protrudes from the toilet seat 2 and a "storing position", which is the position at which the nozzle 50 is hidden by the toilet seat 2.

As illustrated in FIG. 5A, the nozzle receptacle 52 has a cylindrical shape. The nozzle receptacle 52 is formed of any material so long as it is hard to transmit light such as, for example, ultraviolet rays. The material that is hard to transmit ultraviolet rays is, for example, a PBT resin or a resin material kneaded with an ultraviolet absorbent.

The nozzle receptacle 52 accommodates the nozzle 50 in a space 520 inside the nozzle receptacle 52. At this time, the nozzle 50 is moved back and forth in the space 520 inside the nozzle receptacle 52. Then, when the nozzle 50 is at the storage position, the nozzle receptacle 52 shields a portion of the nozzle 50, other than the tip end of the nozzle 50, from the outside.

The shutter 53 is disposed on the tip end side of the nozzle receptacle 52 so as to be rotatable relative to the nozzle receptacle 52. The shutter 53 rotates between an exposure position at which the shutter exposes an opening on the tip end side of the space 520 and a shielding position at which the shutter shields the opening on the tip end side of the space 520. In addition, the shutter 53 may preferably be biased from the exposure position toward the shielding position by a biasing member such as a spring.

Therefore, when the nozzle 50 is located at the storage position, the shutter 53 is located at the shielding position, thereby shielding the tip end of the nozzle 50 from the outside of the space. In addition, when the nozzle 50 is moved from the storage position to the protruding position, the shutter 53 is pushed by the tip end of the nozzle 50, thereby being located at the exposure position. Therefore, the shutter 53 does not obstruct the jet of water from the nozzle 50.

Figure 6:
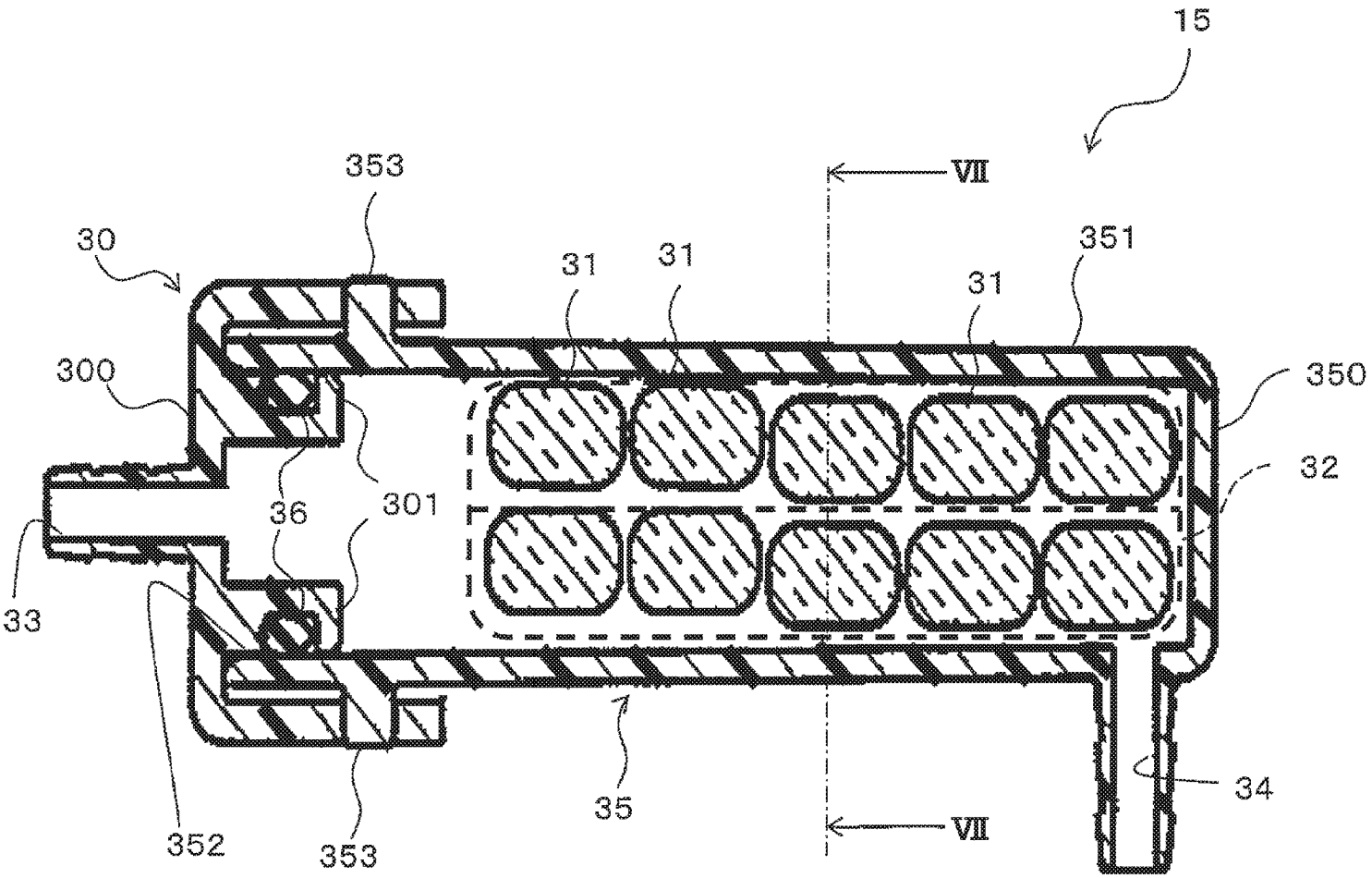
FIG. 6 is a cross-sectional view of a tank when viewed from above.

As illustrated in FIG. 6, the tank 15 includes a tank body 35, a cap 30, and a seal ring 36. The tank body 35 includes a substantially cylindrical peripheral wall 351 and a bottom wall 350, which closes one end side of the peripheral wall 351 in the axial direction. Thus, an opening 352 is formed on the other end side of the peripheral wall 351 in the axial direction. In addition, an outlet port 34 through which water is discharged from the tank 15 is formed in the peripheral wall 351.

The cap 30 includes a covering portion 300, which closes the opening 352 in the tank body 35, and an insertion portion 301, which is inserted into the opening 352 in the tank body 35. An inlet port 33 through which water is introduced into the tank 15 is formed in the covering portion 300.

In this way, the tank 15 is configured by closing the opening 352 in the tank body 35 with the cap 30 in a state where the sterilizing agents 31 are accommodated in the tank body 35. In addition, when a seal ring 36 is interposed between the opening 352 in the tank body 35 and the insertion portion 301 of the cap 30, the leakage of water from the gap between the tank body 35 and the cap 30 is suppressed. In addition, the tank body 35 may be provided with a cap engagement portion 353, which is engaged with the cap 30 in a state where the cap 30 is mounted on the tank body 35. According to this, sudden separation of the cap 30 is suppressed.

The sterilizing agents 31 are formed of a gradually soluble glass solid solution such as phosphate-based glass (or boric-acid-based glass) in which a sterilizing metal element, for example, silver is uniformly included. The sterilizing agents 31 are dissolved in water, thereby enhancing the sterilizing effect of water.

Figure 7:
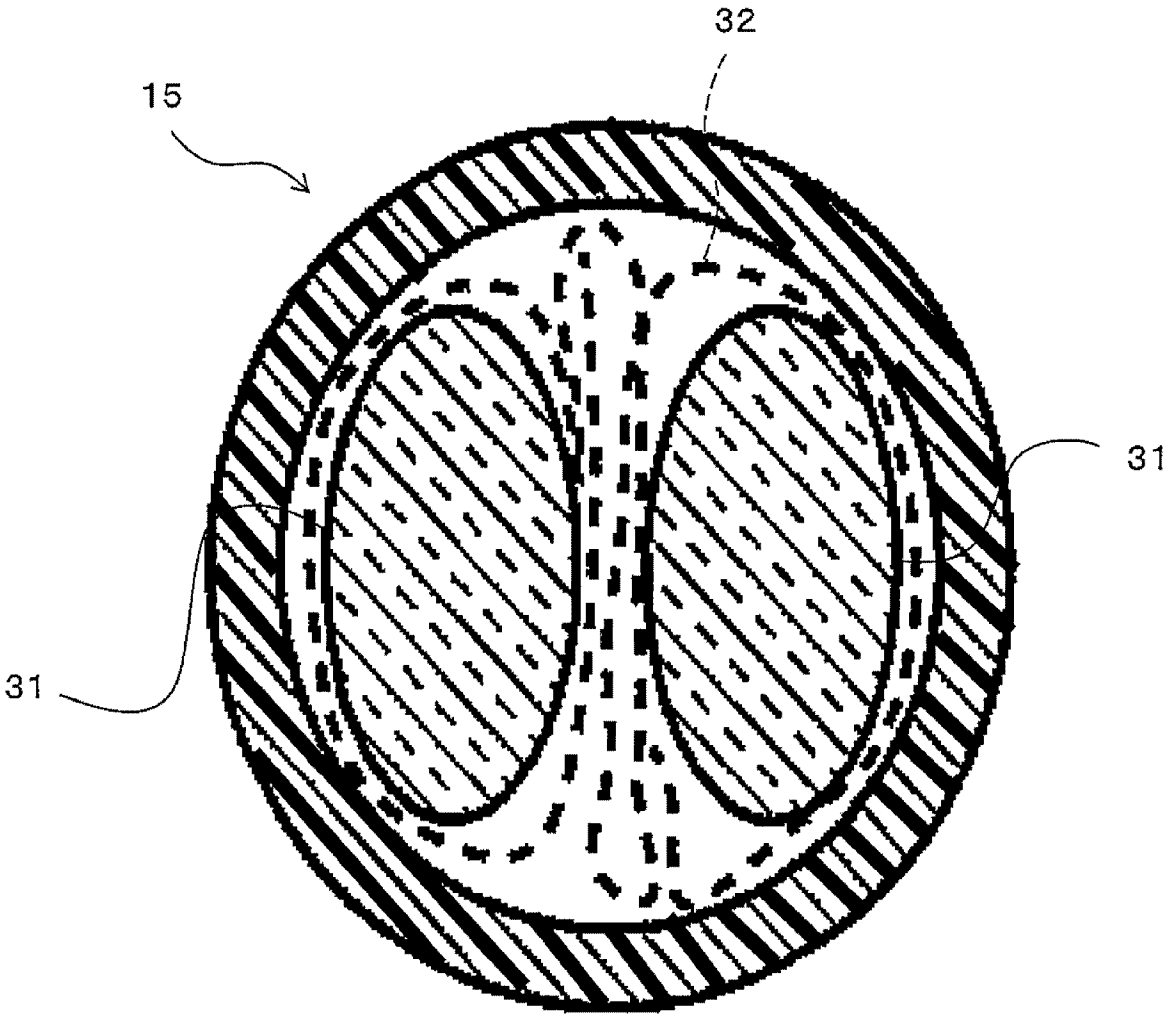
FIG. 7 is a cross-sectional view of the tank taken along line VII-VII in FIG. 6.

As illustrated in FIGS. 6 and 7, the sterilizing agents 31 are accommodated in the tank 15 in a state of being accommodated in a mesh bag 32 having a mesh shape. That is, the mesh bag 32 is disposed between the sterilizing agent 31 and the tank 15 so as to enclose the sterilizing agents 31.

The mesh bag 32 has a rectangular bag shape. The end portions of the mesh bag 32 on the four sides are closed in a state where the sterilizing agents 31 are introduced into the mesh bag 32. The mesh bag 32 is formed of, for example, a resin material such as polyester. In addition, the mesh bag 32 may have elasticity so as to exert a force by which the mesh bag 32 restores the original shape thereof when bent.

The size of the mesh of the mesh bag 32 is set to allow water and air to pass (penetrate) therethrough. For example, the mesh of the mesh bag 32 has a wire diameter of about 50 μm and an opening degree of about 300 μm. In this regard, the opening area of the mesh of the mesh bag 32 is smaller than the opening area of the outlet port 34.

Figure 8A:
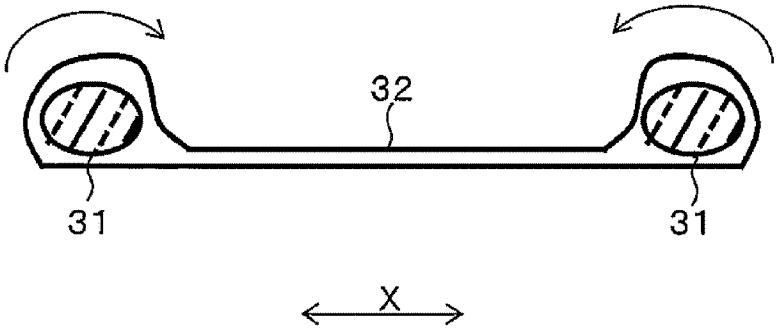
FIGS. 8A to 8C are schematic views illustrating a state where sterilizing agents are enclosed by a mesh bag.
Figure 8B:
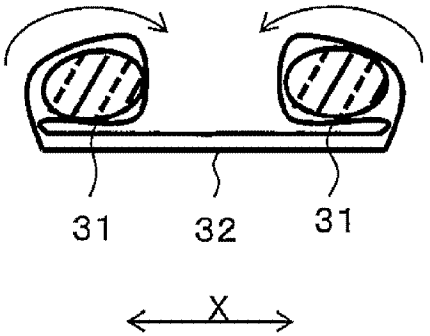

As illustrated in FIG. 8A, the sterilizing agent 31 is disposed on a pair of opposite ends of the mesh bag 32 inside the mesh bag 32. In the following description, the direction of the pair of opposite ends of the mesh bag 32 on which the sterilizing agent 31 is disposed will also be referred to as a "width direction X".

Figure 8C:
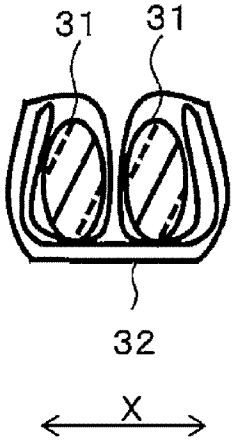

Then, as illustrated in FIG. 88, the mesh bag 32 is wound around the sterilizing agents 31 toward the center of the mesh bag 32 in the width direction X. Thus, as illustrated in FIG. 8C, the mesh bag 32 is folded to overlap around the sterilizing agents 31. The mesh bag 32 is disposed within the tank 15 in this state.

At this time, since the mesh bag 32 has elasticity, a force by which the mesh bag 32 returns from the folded state to the original state thereof is exerted in the tank 15. Thus, the mesh bag 32 presses the sterilizing agent 31 so as to suppress the movement of the sterilizing agents 31.

In addition, when the sterilizing agent 31 is reduced in size due to the use thereof, the mesh bag 32 is deformed by the force by which the mesh bag returns from the folded state to the original state thereof. Thus, the mesh bag 32 may remain in a state of being in contact with the sterilizing agents 31. Therefore, even when the sterilizing agents 31 are reduced in size due to the use thereof, the mesh bag 32 may continuously suppress the movement of the sterilizing agents 31.

As illustrated in FIG. 5A, the nozzle washing unit 16 is provided in the upper portion of the nozzle receptacle 52. Specifically, the nozzle washing unit 16 is provided in order to supply the supplied water to the space 520 of the nozzle receptacle 52.

The nozzle washing unit 16 has a jetting port 40, from which water is jetted to the nozzle 50. The jetting port 40 faces the nozzle 50 when the nozzle 50 of the nozzle unit 14 is in the retracted state in the storage position. Therefore, when the nozzle 50 is in the retracted state in the storage position, the nozzle washing unit 16 washes the nozzle 50 by jetting the water supplied from the tank 15 from the jetting port 40.

The controller 17 is configured with a well-known micro-computer including, for example, a CPU, a RAM, or a RAM. The controller 17 controls the driving of the main valve 11, the switching valve 13, and the drive unit 51 of the nozzle unit 14 by executing the program read from the ROM by the CPU.

Next, the operation of the sanitary washing device 1 will be described with reference to FIG. 2.

First, when the user does not use the sanitary washing device 1, the main valve 11 is in the closed state. In addition, the switching valve 13 is in the state where the inlet portion 24 communicates with none of the first outlet portion 250 and the second outlet portion 251. In addition, the branch flow path 181 and the tank 15 are filled with water.

Under such a circumstance, when the sanitary washing device 1 washes a local region of a human body, the drive unit 51 of the nozzle unit 14 is driven to move the nozzle 50 to the protruding position. Once the nozzle 50 has been moved to the protruding position, the main valve 11 is switched to the opened state. Thus, water is supplied from the supply source 10 to the vacuum breaker 12. Then, in the vacuum breaker 12, the valve body 23 is pushed up by the water supplied from the supply source 10. Thus, the supply source 10 and the switching valve 13 communicate with each other.

At this time, since the switching valve 13 is in the state of interconnecting the first supply flow path 182 and the second supply flow path 183, the water supplied from the supply source 10 is supplied to the nozzle 50 of the nozzle unit 14. Therefore, the nozzle 50 sprays the supplied water from the spray port 500 to a local region of the human body, thereby washing the local region.

When the local washing is completed, the main valve 11 is switched to the closed state. Thus, since the supply of water from the supply source 10 to the vacuum breaker 12 stops, the valve body 23 is lowered by gravity. Therefore, the water remaining in the supply flow path 180 between the vacuum breaker 12 and the nozzle 50 is discharged from the nozzle 50, and a gas (air) is introduced into the supply flow path 180.

Thereafter, the switching valve 13 is switched to the state where the inlet portion 24 communicates with none of the first outlet portion 250 and the second outlet portion 251. Then, the drive unit 51 of the nozzle unit 14 is driven to move the nozzle 50 back to the storage position.

Subsequently, the sanitary washing device 1 performs washing of the nozzle 50. First, the main valve 11 is switched to the opened state. Thus, the supply source 10 and the switching valve 13 communicate with each other.

Thereafter, the switching valve 13 is switched to the state of interconnecting the first supply flow path 182 and the branch flow path 181. At this time, the first supply flow path 182 between the vacuum breaker 12 and the switching valve 13 is filled with air in advance. Therefore, the water supplied from the supply source 10 is supplied to the tank 15 in the state where air is mixed therein.

At this time, in the embodiment disclosed here, since the inlet port 33 and the outlet port 34 of the tank 15 are disposed in different directions, the water stream in the tank 15 may easily become a water stream circulating in the tank 15, rather than a linear water stream flowing from the inlet port 33 to the outlet port 34. Thus, a water stream by which the water introduced into the tank 15 is stirred in the tank 15 is generated.

In addition, since the water introduced into the tank 15 passes through the mesh bag 32, the water becomes a water stream, which avoids the mesh bag 32. Thus, a water stream by which the introduced water is stirred in the tank 15 is generated. At this time, since the inside of the tank 15 is filled with the water in which the sterilizing agents 31 are dissolved, the water introduced into the tank 15 and the water in which the sterilizing agents 31 are dissolved are mixed in the tank 15. Thus, the water in which the sterilizing agents 31 are dissolved is supplied to the nozzle washing unit 16 while being diluted with the water introduced into the tank 15. Therefore, it is possible to prevent the water, in which the sterilizing agents 31 are dissolved, inside the tank 15 from being discharged from the outlet port 34 at an early stage.

In addition, the mesh bag 32 is interposed between the sterilizing agents 31 and the tank body 35 and suppresses the sterilizing agents 31 from directly coming into contact with the tank body 35. Therefore, the mesh bag 32 suppresses the sterilizing agents 31 from moving around inside the tank body 35. In this regard, the mesh bag 32 also functions as a "buffering unit."

In addition, the mesh of the mesh bag 32 adsorbs the gas (contraction unit) included in a fluid introduced into the tank 15. In this respect, the mesh bag 32 also functions as an "adsorption unit." Thus, the mesh of the mesh bag 32 causes the air, which is mixed in the water introduced into the tank 15, to stay in the tank 15.

In addition, the nozzle washing unit 16 jets the water supplied from the tank 15 from the jetting port 40 to the nozzle 50 of the nozzle unit 14. In this way, the nozzle 50 is washed with water having a sterilizing component after the local washing.

Thereafter, the switching valve 13 is switched to a state of interconnecting the first supply flow path 182 and the second supply flow path 183, and the main valve 11 is switched to the closed state. Thus, since the supply of water from the supply source 10 to the vacuum breaker 12 stops, the valve body 23 is lowered by gravity. Therefore, the outlet flow path 21 is connected to the atmosphere communication port 22 and is not connected to the inlet flow path 20. Thus, the water remaining in the supply flow path 180 between the vacuum breaker 12 and the nozzle 50 is discharged from the nozzle 50.

Here, since the first supply flow path 182 and the branch flow path 181 are not connected to each other, the water in the branch flow path 181 is not discharged. Thus, since the tank 15 is continuously filled with water, the sterilizing agent 31 may be easily dissolved under the condition in which the sanitary washing device 1 is not used.

Therefore, at the time of next nozzle washing, the sterilizing effect of water jetted from the jetting port 40 of the nozzle washing unit 16 may be increased by mixing the water in the tank 15, in which the sterilizing agent 31 is dissolved, with the water supplied from the supply source 10.

In addition, since the water remaining in the supply flow path 180 between the vacuum breaker 12 and the nozzle 50 is discharged from the nozzle 50, the water used for nozzle washing is washed away from the nozzle 50.

Then, when the discharge of water is completed, the switching valve 13 is switched to the state where the inlet portion 24 communicates with none of the first outlet portion 250 and the second outlet portion 251.

In addition, the sanitary washing device 1 may be used under a low temperature condition or may be left after use. However, when the sanitary washing device 1 is placed under a low temperature condition, the water remaining in the tank 15 freezes, which may cause deformation of the tank 15.

In this regard, in the embodiment disclosed here, the mesh of the mesh bag 32 in the tank 15 is easily brought into a state of adsorbing the air even after the nozzle washing by the nozzle washing unit 16 is completed. Therefore, even when the water in the tank 15 freezes, it is possible to suppress an increase in the internal pressure of the tank 15. Specifically, when the water in the tank 15 freezes, the volume of water expands in this process. Thus, since the water in the tank 15 pushes the inner wall of the tank 15, the internal pressure of the tank 15 rises.

At this time, since the mesh of the mesh bag 32 in the tank 15 has adsorbed air, the air is contracted by expansion of the water in the tank 15. Therefore, when the water in the tank 15 freezes, it is possible to suppress an increase in the internal pressure of the tank 15 due to the expansion of the water.

According to the above-described embodiment, the following effects may be obtained.

(1) Since the mesh bag 32 is disposed between the sterilizing agents 31 and the inner wall of the tank 15, it is possible to suppress the sterilizing agents 31 from directly colliding with the inner wall of the tank 15. Therefore, it is possible to suppress the sterilizing agents 31 provided in the tank 15 from generating abnormal noise.

(2) Since the mesh bag 32 has the shape of a bag that encloses the sterilizing agents 31, a buffering unit is provided between the sterilizing agents 31 and the inner wall of the tank 15. Therefore, it is possible to suppress the sterilizing agents 31 provided in the tank 15 from generating abnormal noise.

(3) By disposing the mesh bag 32 in the tank 15 in a folded state, it is possible to reduce the gap in the tank 15. Thus, since the space in which the sterilizing agents 31 may move is reduced, the movement of the sterilizing agents 31 is limited. Thereby, it is possible to suppress the collision between the sterilizing agents 31 and the tank 15 and the collision between the sterilizing agents 31. Therefore, it is possible to further suppress the sterilizing agents 31 provided in the tank 15 from generating abnormal noise.

(4) Since the opening area of the mesh of the mesh bag 32 is smaller than the opening area of the outlet port 34 of the tank 15, when the sterilizing agents 31 are broken to a size that is equal to or greater than the opening area of the mesh of the mesh bag 32 inside the mesh bag 32, the broken sterilizing agents 31 may stay inside the mesh bag 32. On the other hand, when the sterilizing agents 31 are broken to a size that is smaller than the opening area of the mesh of the mesh bag 32 inside the mesh bag 32, the broken sterilizing agents 31 reach the outlet port 34. However, in this case, since the broken sterilizing agents 31 are smaller than the opening area of the outlet port 34, the sterilizing agents 31 easily flow to the downstream side without clogging the outlet port 34. Therefore, it is possible to suppress the outlet port 34 in the tank 15 from being filled and clogged with the sterilizing agents 31.

(5) In the case where the water supplied from the supply source 10 is tap water, when the concentration of the sterilizing agents 31 dissolved in the water, which is used for nozzle washing, is increased, chloride ions contained in tap water and silver ions contained in the water used for nozzle washing are combined with each other so as to form a silver chloride. Then, when the silver chloride is exposed to light, the silver chloride is reduced to silver by an auto-oxidation-reduction reaction, the portion on which the silver chloride has adhered becomes black.

Therefore, in a case where the concentration of the sterilizing agent 31 dissolved in the water, which is jetted from the nozzle washing unit 16 to the nozzle 50, is high, when the nozzle 50 is exposed to light in the state where the water adheres thereto, the nozzle 50 may become black. In this regard, while the nozzle 50 is located at the storage position, the nozzle 50 of the embodiment disclosed here is shielded from the outside by the nozzle receptacle 52 and the shutter 53, which are formed of a material that does not transmit light. As a result, it is possible to suppress the nozzle 50 from being blackened.

(6) After performing the nozzle washing, since the water remaining in the supply flow path 180 between the vacuum breaker 12 and the nozzle 50 is discharged from the nozzle 50, the water used for nozzle washing is washed away from the nozzle 50. As a result, it is possible to further suppress the nozzle 50 from being blackened even in the case where the concentration of the sterilizing agent 31 dissolved in the water, which is jetted from the nozzle washing unit 16 to the nozzle 50, is high.

Hereinafter, another embodiment of the above-described embodiment will be described.

Figure 9:
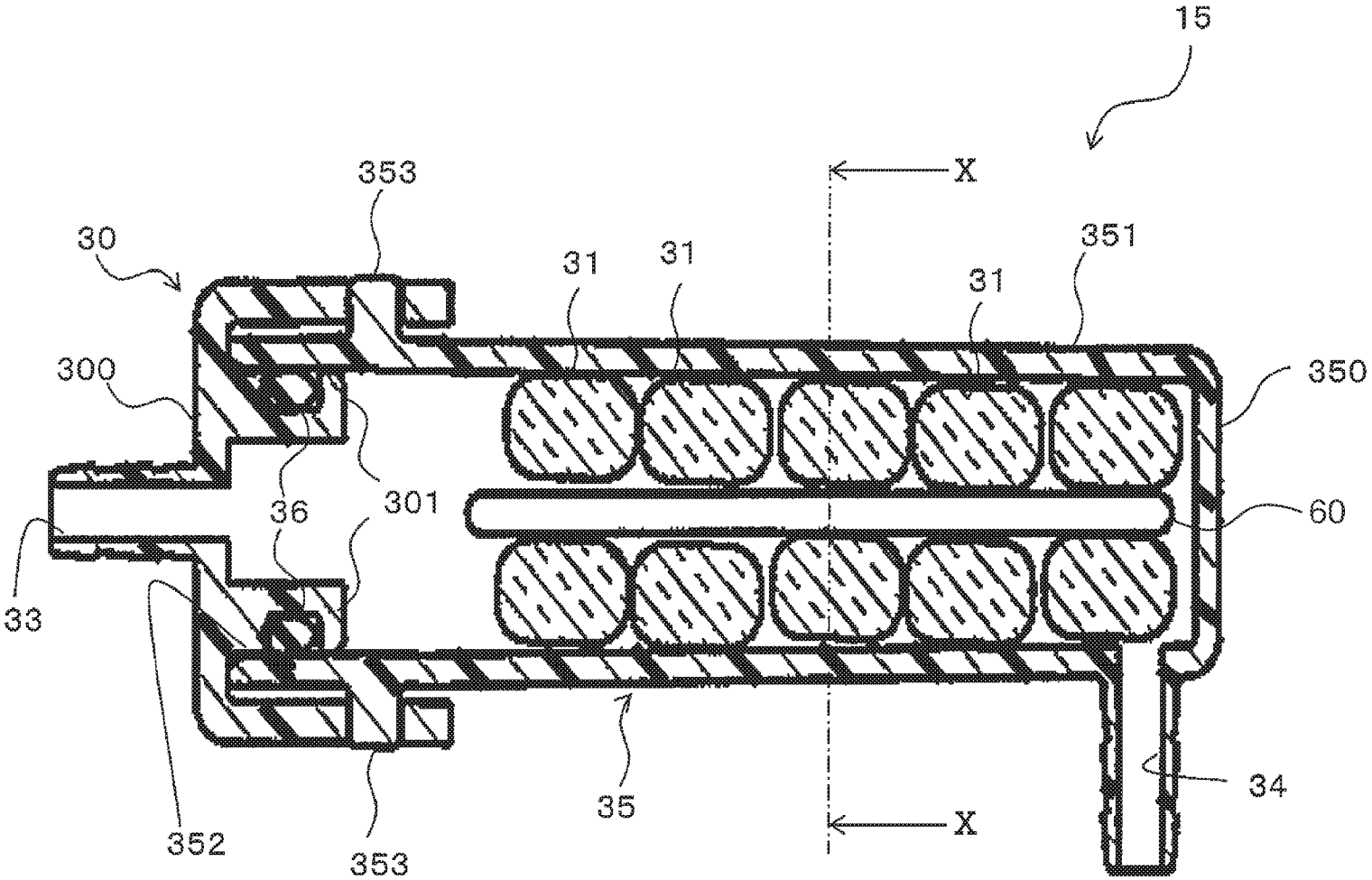
FIG. 9 is a cross-sectional view of a tank in a sanitary washing device according to another embodiment when viewed from above.
Figure 10:
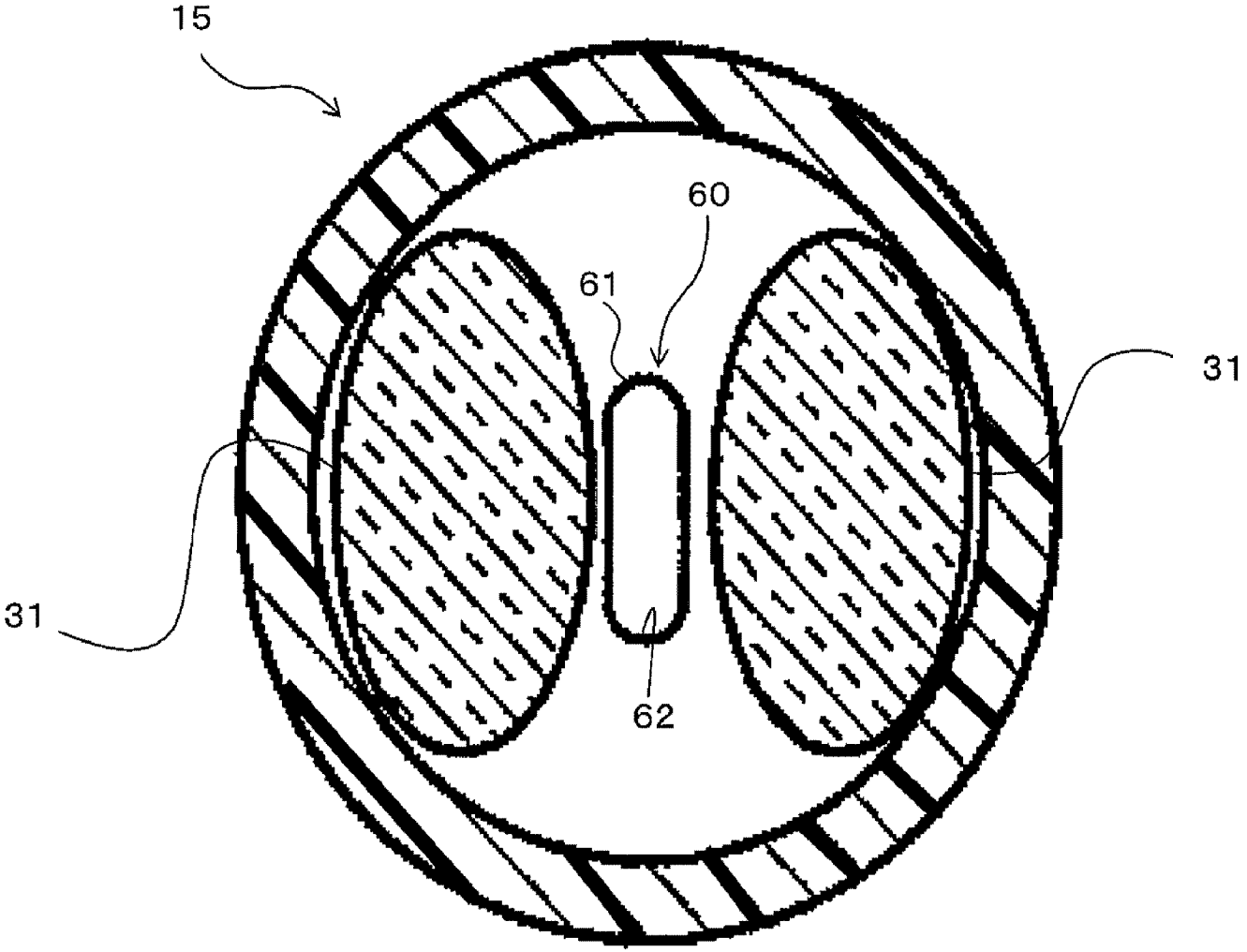
FIG. 10 is a cross-sectional view of the tank taken along line X-X in FIG. 9.

As illustrated in FIGS. 9 and 10, instead of the mesh bag 32, a balloon 60 (a contraction element), into which gas is introduced, may be disposed in the tank 15.

The balloon 60 includes an elastic wall portion 61 having elasticity and a gas chamber 62, which stores gas in the space enclosed by the elastic wall portion 61. The elastic wall portion 61 is formed of, for example, rubber. The elastic wall portion 61 is provided so as to seal a gas (e.g., air) therein. Thus, the gas chamber 62 is formed to store the air therein.

By disposing the balloon 60 in the tank 15, when the water in the tank 15 freezes, the elastic wall portion 61 is pushed by the frozen water so that the air in the gas chamber 62 is compressed. Thus, since the balloon 60 contracts, it is possible to suppress the internal pressure of the tank 15 from increasing when the water in the tank 15 expands.

In addition, the balloon 60 is inserted into the tank 15 to be sandwiched between the sterilizing agents 31, thereby being disposed in the center of the tank 15. When the balloon 60 is disposed outside the tank 15, the balloon 60 may not allow the internal pressure of the tank 15 to increase when the water inside the tank 15 freezes. On the other hand, when the balloon 60 is disposed at the center of the tank 15, the balloon 60 may suppress the internal pressure of the tank 15 from increasing when the water inside the tank 15 freezes.

The opening area of the mesh of the mesh bag 32 may be greater than or equal to the opening area of the outlet port 34 of the tank 15. Thus, it is possible to prevent the momentum of the water stream generated in the water inside the tank 15 from being weakened by the mesh bag 32.

The mesh bag 32 may not be disposed in the tank 15 in a folded state. For example, the mesh bag 32 may not be foldable since it has only a space into which the sterilizing agents 31 are introduced. Thus, it is possible to prevent the momentum of the water stream generated in the water inside the tank 15 from being weakened by the mesh bag 32.

Instead of the mesh bag 32, a simple woven fabric or nonwoven fabric may be placed on the inner wall of the tank 15. Thus, it is possible to reduce the effort of putting the sterilizing agent 31 into the mesh bag 32 when the sterilizing agents 31 are inserted into the tank 15.

The liquid supplied from the supply source 10 may not be water. For example, liquid to which a sterilizing effect is added in advance may be supplied. Thus, a sufficient sterilization effect may be obtained even when only a small amount of the sterilizing agents 31 may be dissolved.

The balloon 60 may not be provided at the center of the tank 15. For example, the balloon 60 may be disposed depending on the shape or size of the tank 15 and the sterilizing agents 31.

Instead of the balloon 60, a foam containing air may be provided in the tank 15.

The mesh bag 32 may adsorb the gas introduced into the tank 15, which is not limited to air. In addition, the gas stored in the foam or the balloon 60 may not be air.

The vacuum breaker 12 may not be provided. For example, the main valve 11 and the switching valve 13 may be connected to each other without interposing the vacuum breaker 12 therebetween. In this case, the mesh bag 32 adsorbs the air originally contained in the water supplied from the supply source 10.

In the case of performing local washing, water may be jetted from the nozzle 50 at the storage position of the nozzle 50 before the local washing is performed by the nozzle 50. In this case, the water in which the sterilizing agents 31, which have adhered to the nozzle 50 at the time of previous local washing, are dissolved is washed out from the nozzle 50 at the time of current local washing.

A three-way valve may be provided on the upstream side of the tank 15 in the branch flow path 181 to switch the supply destination of water supplied from the first supply flow path 182 to the branch flow path 181. In this case, the sanitary washing device 1 may include a spray mechanism, which suppresses dirt from adhering to the toilet bowl by spraying water into the toilet bowl. According to this, the three-way valve may be switched to any one of a state of supplying the water supplied from the first supply flow path 182 to the tank 15 and a state of supplying the water to the spray mechanism.

In addition, in the case where such a three-way valve is provided, the switching valve 13 may not be provided. That is, the supply flow path 180 and the branch flow path 181 may be connected to each other without interposing the switching valve 13 therebetween.

A sanitary washing device according to an aspect of this disclosure includes: a nozzle configured to wash a local region of a human body; a tank configured to accommodate a sterilizing agent, a sterilizing component of which is dissolved into liquid, and to store supplied liquid therein; a nozzle washing unit configured to wash the nozzle using liquid supplied from the tank; and a buffering unit disposed between the sterilizing agent and an inner wall of the tank inside the tank and having liquid permeability.

According to this configuration, by disposing the buffering unit between the sterilizing agent and the inner wall of the tank, it is possible to suppress the sterilizing agent from directly colliding with the inner wall of the tank. Therefore, it is possible to suppress the sterilizing agent provided in the tank from generating abnormal noise.

In the sanitary washing device, it is preferable that the buffering unit has a bag shape that encloses the sterilizing agent.

According to this configuration, the buffering unit is provided between the sterilizing agent and the inner wall of the tank. Therefore, it is possible to further suppress the sterilizing agent provided in the tank from generating abnormal noise.

In the sanitary washing device, it is preferable that the buffering unit is disposed in the tank in a folded state.

According to this configuration, since the buffering unit is disposed in the folded state in the tank, the movement of the sterilizing agents enclosed in the buffering unit is limited. Thus, it is possible to suppress the sterilizing agents and the tank from colliding with each other or to suppress the sterilizing agents from colliding with each other.

In the sanitary washing device, it is preferable that the tank has an outlet port that discharges the liquid toward the nozzle washing unit, the buffering unit has a mesh shape, and the buffering unit has a mesh opening area smaller than an opening area of the outlet port.

According to this configuration, when the sterilizing agent is broken inside the buffering unit to a size that is equal to or greater than the opening area of the mesh, the broken sterilizing agents may stay inside the buffering unit. On the other hand, when the sterilizing agent is broken inside the buffering unit into a size that is smaller than the opening area of the mesh, the broken sterilizing agents reach the outlet port. However, in this case, since the broken sterilizing agents are smaller than the opening area of the outlet port, the sterilizing agents easily flow to the downstream side without clogging the outlet port. In this way, according to this configuration, it is possible to suppress the outlet port formed in the tank from being filled and clogged with the sterilizing agents.

In the sanitary washing device, it is preferable that the tank has an outlet port that discharges the liquid toward the nozzle washing unit, the buffering unit has a mesh shape, and the buffering unit has a mesh opening area greater than or equal to an opening area of the outlet port.

According to this configuration, it is possible to suppress the momentum of a water stream generated in the water inside the tank from being weakened by the buffering unit.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sanitary washing device comprising:

a nozzle configured to wash a local region of a human body;

a tank configured to accommodate a sterilizing agent, a sterilizing component of which is dissolved into liquid, and to store supplied liquid therein;

a nozzle washing unit configured to wash the nozzle using liquid supplied from the tank; and a buffering unit disposed between the sterilizing agent and an inner wall of the tank inside the tank and having liquid permeability, wherein the buffering unit has a bag shape that encloses the sterilizing agent, and the buffering unit is disposed in the tank in a folded state.

2. The sanitary washing device according to claim 1, wherein the tank has an outlet port that discharges the liquid toward the nozzle washing unit, the buffering unit has a mesh shape, and the buffering unit has a mesh opening area smaller than an opening area of the outlet port.

3. A sanitary washing device comprising:

a nozzle configured to wash a local region of a human body;

a tank configured to accommodate a sterilizing agent, a sterilizing component of which is dissolved into liquid, and to store supplied liquid therein;

a nozzle washing unit configured to wash the nozzle using liquid supplied from the tank; and a buffering unit disposed between the sterilizing agent and an inner wall of the tank inside the tank and having liquid permeability, wherein the buffering unit is disposed in the tank in a folded state, the tank has an outlet port that discharges the liquid toward the nozzle washing unit, the buffering unit has a mesh shape, and the buffering unit has a mesh opening area smaller than an opening area of the outlet port.

4. The sanitary washing device according to claim 1, wherein the tank has an outlet port that discharges the liquid toward the nozzle washing unit, the buffering unit has a mesh shape, and the buffering unit has a mesh opening area greater than or equal to an opening area of the outlet port.

5. A sanitary washing device comprising:

a nozzle configured to wash a local region of a human body;

a tank configured to accommodate a sterilizing agent, a sterilizing component of which is dissolved into liquid, and to store supplied liquid therein;

a nozzle washing unit configured to wash the nozzle using liquid supplied from the tank; and a buffering unit disposed between the sterilizing agent and an inner wall of the tank inside the tank and having liquid permeability, wherein the buffering unit is disposed in the tank in a folded state, the tank has an outlet port that discharges the liquid toward the nozzle washing unit, the buffering unit has a mesh shape, and the buffering unit has a mesh opening area greater than or equal to an opening area of the outlet port.

* * * * *